US010933683B2

(12) United States Patent
Lehmann

(10) Patent No.: US 10,933,683 B2
(45) Date of Patent: Mar. 2, 2021

(54) INSERTING SYSTEM

(71) Applicant: KERN AG, Konolfingen (CH)

(72) Inventor: Urs Lehmann, Grosshöchstetten (CH)

(73) Assignee: KERN AG, Konolfingen (CH)

( * ) Notice: Subject to any disclaimer, the term of this patent is extended or adjusted under 35 U.S.C. 154(b) by 174 days.

(21) Appl. No.: 16/306,392

(22) PCT Filed: May 10, 2017

(86) PCT No.: PCT/EP2017/061197
§ 371 (c)(1),
(2) Date: Nov. 30, 2018

(87) PCT Pub. No.: WO2017/207233
PCT Pub. Date: Dec. 7, 2017

(65) Prior Publication Data

US 2019/0344605 A1 Nov. 14, 2019

(30) Foreign Application Priority Data

May 30, 2016 (CH) ..... 00689/16

(51) Int. Cl.
*B43M 3/04* (2006.01)

(52) U.S. Cl.
CPC ..... *B43M 3/045* (2013.01)

(58) Field of Classification Search
CPC ..... B43M 3/045; B43M 3/00; B43M 3/04
(Continued)

(56) References Cited

U.S. PATENT DOCUMENTS

RE24,459 E 4/1958 Kern
2,915,863 A * 12/1959 Kummer ..... B43M 3/045 53/117

(Continued)

FOREIGN PATENT DOCUMENTS

CH 567943 A5 10/1975
CH 710 033 A2 2/2016

(Continued)

OTHER PUBLICATIONS

Aug. 21, 2017 International Search Report issued in International Application PCT/EP2017/061197.

(Continued)

*Primary Examiner* — Nathaniel C Chukwurah
*Assistant Examiner* — Lucas E. A. Palmer
(74) *Attorney, Agent, or Firm* — Oliff PLC

(57) ABSTRACT

An envelope inserting system has an envelope duct for empty envelopes, a transport device for transporting the envelopes from the duct to a packing pocket, a feeding device for feeding the envelope content to and into the pocket, and an outlet-transport device for reforwarding the filled envelope. The transport device has an envelope tunnel mounted movably on the inserting system about a pivot axis, upper and lower tunnel guidances for aligning the envelope with the pocket, and a swivel device operatively connected to the tunnel, and at least one drivable envelope pusher roll. The roll, in a first position, which the tunnel and roll occupy relative to the pocket, is fed from below against the downstream end portion of the upper tunnel guidance and a lower edge of an end edge of the end region is offset downwards relative to a plane defined by the guiding surface of the pocket.

19 Claims, 8 Drawing Sheets

(58) Field of Classification Search
USPC ..... 53/473
See application file for complete search history.

(56) References Cited

U.S. PATENT DOCUMENTS 3,253,384 A * 5/1966 Huck ..... B43M 5/042 53/53
4,674,258 A * 6/1987 Ehlscheid ..... B43M 3/045 53/154
5,251,425 A * 10/1993 Kern ..... B65H 3/26 53/381.7
5,255,498 A * 10/1993 Hotchkiss ..... B43M 3/045 53/258
5,517,797 A * 5/1996 Ballard ..... B43M 3/045 53/381.5
5,642,598 A * 7/1997 Cannaverde ..... B43M 3/045 53/284.3
5,660,030 A * 8/1997 Auerbach ..... B43M 3/045 53/284.3
5,944,304 A * 8/1999 Branecky ..... B43M 3/045 270/58.06
6,098,374 A * 8/2000 Yates ..... B43M 3/045 53/381.5
2003/0022780 A1* 1/2003 Ifkovits ..... B43M 5/04 493/419
2004/0250517 A1* 12/2004 Hsieh ..... B43M 3/045 53/569
2005/0060966 A1* 3/2005 Ballestrazzi ..... B43M 3/045 53/569
2017/0253073 A1* 9/2017 Lehmann ..... B43M 3/045
2017/0267017 A1* 9/2017 Lehmann ..... B43M 3/045

FOREIGN PATENT DOCUMENTS

EP 504114 A1 9/1992
EP 1016549 A1 7/2000
JP H09-286410 A 11/1997
WO 2016/026712 A1 2/2016
WO WO-2016026712 A1 * 2/2016 ..... B43M 3/045

OTHER PUBLICATIONS

Aug. 21, 2017 Written Opinion issued in International Application PCT/EP2017/061197.
Dec. 4, 2018 International Preliminary Report on Patentability issued in International Patent Application PCT/EP2017/061197.

* cited by examiner

INSERTING SYSTEM

The invention relates to an inserting machine for automatically filling envelopes according to claim 1, as well as a method for operating such an inserting machine according to the preamble of claim 15.

Various inserting machines are known from the prior art. For example, WO 2016/026712 A1 discloses a movable funnel-shaped element for aligning the envelope on a packing pocket, and means for pulling the envelope on the packing pocket. These are necessary because, due to the large distance from the transport rolls upstream of the funnel to the packing pocket, the envelope cannot be pushed completely onto the packing pocket by the transport rolls alone through the funnel. It has also been recognized that such a design is particularly susceptible to wear in the area of envelope pull rolls.

One of the objects of the present application is to avoid the above-mentioned disadvantages of the prior art and to provide an inserting system that is as reliable as possible in operation and less susceptible to wear and tear. It is a further object to provide an inserting system with a high degree of flexibility that can process the large variance of envelope formats and qualities with little or no changeover effort. Furthermore, low manufacturing costs and high reliability were objects of the invention.

An inserting system according to the invention for inserting envelope content into an envelope thus comprises, similar to the prior art, an envelope duct for empty envelopes, a flap opener for opening an envelope flap of the envelope, various transport means for transporting the envelope from the envelope duct to a packing pocket on which the envelopes are filled, and a feeding device, for feeding the envelope content to the packing pocket and into the packing pocket, wherein the transport means comprise an envelope tunnel mounted on the inserting system K so as to be movable about a pivot axis, having an upper tunnel guidance and a lower tunnel guidance, for aligning the envelope onto the packing pocket, and swivel means operatively connected to the envelope tunnel, as well as at least one drivable envelope pusher roll. In addition, the system comprises outlet-transport means for reforwarding the envelope filled with the envelope content.

In accordance with the invention, the envelope pusher roll, in a first position which the envelope tunnel and the envelope pusher roll occupy relative to the packing pocket, is fed from below towards the end region of the upper tunnel guidance located downstream, and the end edge of the end region is located in the transport direction T directly in front of a front edge of the packing pocket. The distance can be adjusted laterally offset in a range from 1 to 15 mm, preferably between 1 and 5 mm, i.e. directly in front of the front edge of the packing pocket. A lower edge of the end edge can be offset downwards by 1 to 6 mm, in particular by 2 to 3 mm, in relation to a defined, for example horizontal plane spanned by the guiding surface of the packing pocket. This also depends on the angle of the bend in the end region of the upper tunnel guidance. The term "feed" here refers to a contactless advance of the roll, depending on the stiffness of the envelope, e.g. at a distance of 0.5 to 2.0 mm, in particular approx. 1 mm, in order to enable the lowest-wear operation of the inserting system. The envelope touches the roll due to the curved guidance and is thus transported further.

In a so-called intermediate position which is raised relative to the first position and which the envelope tunnel and the envelope pusher roll can occupy relative to the packing pocket, the envelope pusher roll can also be fed from below towards the end region (88) of the upper tunnel guidance (82) which is located downstream, wherein the envelope pusher roll is now located however directly in front of the front edge (21) of the packing pocket (20) with respect to the transport direction T. Depending on the diameter selected, the center point of the envelope pusher roll can be 5 mm to 20 mm, in particular 10 mm to 15 mm in front of the edge of the packing pocket. The height of the top point of the roll (i.e. the point where the upper horizontal tangent lies) is 0 mm to 12 mm, in particular 2 mm to 4 mm, above the top edge of the front edge of the packing pocket.

In a so-called second position, which is occupied by the envelope tunnel and the envelope pusher roll relative to the packing pocket, these can be pivoted away from the front edge and the transport path in transport direction A between packing pocket and transport means can be released.

The packing pocket can be connected to the inserting machine K in a fixed position. The envelope tunnel can comprise an area in which the tunnel guidances are formed in a parallel way.

The envelope pusher roll can be connected to synchronous means for synchronous feeding of the envelope pusher roll to the envelope tunnel or for synchronous pivoting away from the envelope tunnel.

Swivel means and synchronizing means can each comprise a cam disc and at least one lever, wherein the at least one lever of the swivel means connects the cam disc to the envelope tunnel and the at least one lever of the synchronizing means connects the cam disc to the envelope pusher roll via pivot points. In this case, the levers can each be guided over several pivot points on the cam disc to increase stability. The cam discs can be driven in this case by a drive arranged on the device side via a driving wheel and driving means together.

Alternatively, swivel means and synchronizing means can each include a synchronous motor to synchronously control the pivoting movements of the envelope tunnel and envelope pusher roll.

If the envelope pusher roll is connected in fixed position to the envelope tunnel, i.e. rigid or resilient, the synchronizing means can be omitted and the drive can only interact with the swivel means. Driving means can be a drive belt, a toothed belt or a chain.

In principle, one drive can be used to simultaneously drive all moving parts of the transport system, in particular swivel and synchronizing means, means of transport with drive rolls such as envelope pusher roll, as well as feeding means such as collecting and insertion chain, etc., which simplifies the construction and synchronization of the system.

In the second position, the envelope pusher roll can be pivoted downwards with respect to the plane formed by the guiding surface and the envelope tunnel can be pivoted upwards with respect to the plane formed by the guiding surface. Alternatively, in the second position, the envelope pusher roll and the envelope tunnel can be pivoted upwards with respect to the plane formed by the guiding surface.

In one embodiment of the invention, the envelope tunnel has an entrance area, followed by a straight guide area in the transport direction T downstream and a curve downstream adjacent thereto, wherein the tunnel guidances are formed parallel in the guide area and in the area of the curve. This geometry of the envelope tunnel allows the envelope to be ideally fed, thus facilitating the opening of the envelope in conjunction with a pivoting movement relative to the guiding surface of the packing pocket fixed to the inserting system. The entrance area can be funnel-shaped to facilitate the insertion of the envelope. With regard to the use of the two terms top/bottom, it should be noted here that this is used in connection with an inserting system in which the envelopes are pushed onto the flap guide arranged here on the lower side of the packing pocket with an open flap at the bottom with respect to a backside of the envelope opposite the flap side of the envelope. It is understood by the person skilled in the art that in an inserting system in which the envelopes are pushed onto the packing pocket with the envelope flap at the top with respect to the backside of the envelope, the terms used in this context at the top/bottom must be reversed in an analogous reverse conclusion and the packing pocket must now be installed with the flap guide at the top and the envelope tunnel rotated 180° about the transport axis, for example. In this case, the transport roll described below is also fed from above instead of from below. Nevertheless, it is understood by the person skilled in the art that with an inserting system in which the envelope is fed in from below, the terms top/bottom must be reversed again in an analogous reverse conclusion. Such inserting systems are therefore expressly included in the present invention.

The envelope tunnel may comprise at least one drive roll and at least one outlet roll for interaction with a drive roll. The rolls can either be mounted on the envelope tunnel, or the envelope tunnel can be mounted, e.g. pivotably, around or on an axis of a drive roll attached to the inserting machine. The rotation of the drive roll and the pivoting of the envelope tunnel take place independently of each other, e.g. via separate bearings.

The envelope tunnel is shaped in such a way that it guides the envelope against the envelope pusher roll. This can also be designed as a wide roll and can include, for example, a friction coating. It can consist of rubber, polyurethane etc. or a granular surface, e.g. diamond, tungsten carbide etc. In order to transport as wide a variety of envelope formats as possible, the envelope tunnel can additionally have one or more back-pressure rolls which run with the envelope pusher roll in the first and intermediate position and which are mounted in one or more recesses in the upper tunnel guidance.

The straight guide area mentioned above can be longer than the entrance area and longer than the area comprising the curve, wherein the length can be selected, for example, between a quarter and three-quarter envelope length (distance between envelope edge and envelope bottom) of the shortest envelope format to be processed.

The upper tunnel guidance may extend downstream beyond the curve and downstream end of the lower tunnel guidance. The lower tunnel guidance may extend upwards beyond the entrance area and upwards beyond the end of the upper tunnel guidance. The pivot bearing of the envelope tunnel may be provided at its upstream end.

A method for operating an inserting system usually comprises removing an envelope from an envelope duct, wherein the flap of the envelope closest to an envelope removal opening of an envelope duct, a stack of envelopes placed in the envelope duct, is opened by a flap opener, whereupon the transport means transport the envelope with the opened envelope flap in front to a packing pocket on which the envelopes are filled and the envelope content is fed to and into the packing pocket by means of a feeding device. The filled envelope is then transported further via outlet-transport means.

In accordance with the invention, an envelope tunnel and an envelope pusher roll will be brought into a first position relative to the packing pocket, in which an end edge of a downstream end section of an upper tunnel guidance in transport direction T is located immediately in front of a front edge of the packing pocket, and the envelope pusher roll, fed from below towards the end region, is operated in transport direction T, whereby the envelope flap is pushed under the front edge of the packing pocket parallel to or at a flat transport angle W1 under a guiding surface of the packing pocket. In this case, the angle W1 can also be implemented as negative, i.e. directed downwards. The angle W1 can be set between +15° and −15°, preferably between −5° and +5°.

In an intermediate step, as soon as the envelope flap is below the guiding surface, the envelope pusher roll and envelope tunnel can then be pivoted into a so-called intermediate position raised relative to the first position, whereby the envelope pusher roll is located directly in front of the front edge of the packing pocket in the direction of the transport path T and the envelope flap is fed from the envelope tunnel to the packing pocket at a transport angle W2. In this case, the envelope pusher roll continues to be fed from below against the downstream end region of the upper tunnel guidance in transport direction T, whereby the envelope is opened for pushing-on and loading with envelope content onto the packing pocket. The transport angle is in transport direction T for the envelope front with the flap facing downwards at angle W2 and for the envelope back horizontal or upwards at angle W3. The angles are set in each case from the tangent of the last point of contact with the envelope pusher roll to the packing pocket. Angle W3 is between 0° and 20°, especially 5° to 10°.

In a so-called second step, after the envelope has been fully pushed onto the packing pocket, the envelope pusher roll and the envelope tunnel can be pivoted away from the front edge into a so-called second position, whereby the transport path in transport direction A between the packing pocket and the outlet-transport means is released. In the second step, the envelope pusher roll can be pivoted downwards with respect to the plane formed by the guiding surface and the envelope tunnel can be pivoted upwards with respect to the plane formed by the guiding surface. The pivoting movements of the envelope pusher roll and envelope tunnel can be synchronized by means of swivel means and synchronizing means.

Alternatively, in the second step, the envelope pusher roll and envelope tunnel can be pivoted upwards away in relation to the plane formed by the guiding surface, e.g. jointly by the swivel means.

In a further embodiment of the invention, a driven transport roll, which is mounted on the envelope tunnel in the area of the lower tunnel guidance and pivoted with it and which in a position, e.g. in cooperation with an outlet roll mounted opposite on the upper tunnel guidance, transports an empty envelope further through the tunnel in the transport direction T, further transports a filled envelope in the transport direction A at the same time, in a time-shifted manner and/or in another position with an outlet-transport roll arranged underneath, which can also be constructed as a back-pressure roll. The outlet-transport roll can be elastic, elastically coated or spring-mounted. This has the advantage over the use of the usual circular segments that the movement of the outlet-transport roll does not have to be synchronized with the envelope removal.

In another embodiment of the invention, in which the movement of the envelope tunnel and the pusher roll, which can also be designed as a pusher cylinder, is controlled by cam discs as mentioned above, the cam discs can also be driven separately instead of using a common driving means (electronic shaft, servo drives, stepper motors), so that the movements can be optimized for certain envelopes and the performance can be increased by means of parameterization in the application.

As an alternative to operating the envelope tunnel and the pusher roll with two cam discs, the two control cams 90', 91' can also be integrated into one cam, making the system more compact and cost-effective.

In order to facilitate the setting when the machine is first put into operation, mechanically precisely adjustable levers are used to transmit the movements from the cam discs or from the cam disc. This allows readjustments and optimizations to be made even during maintenance work.

In another embodiment of the invention, the cam disc of the swivel device is open at the so-called zero point, i.e. when the envelope tunnel is pivoted upwards, which corresponds to position two here, in order to facilitate manual opening and access for repairing malfunctions.

With regard to the packing pocket, it should be mentioned that the width of said pocket can be adjusted, which provides greater flexibility.

In the following, the invention is described by way of example by means of the drawings. FIGS. 1 to 5 show different phases during the filling of an envelope on an inserting system according to the invention.

Figure 6:
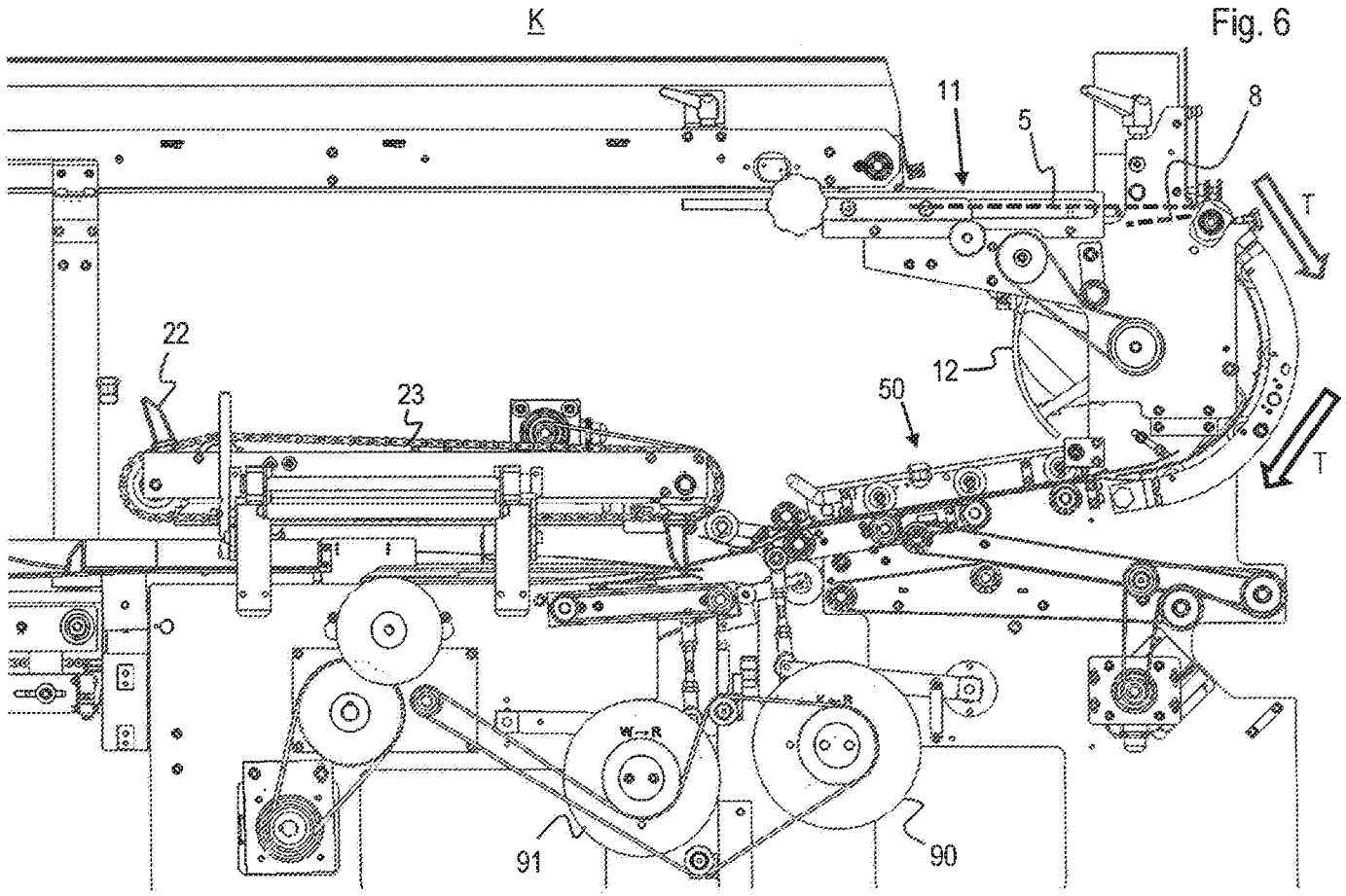
FIG. 6 shows an overview in a side view with envelope duct (analogously to FIG. 5)
Figure 7:
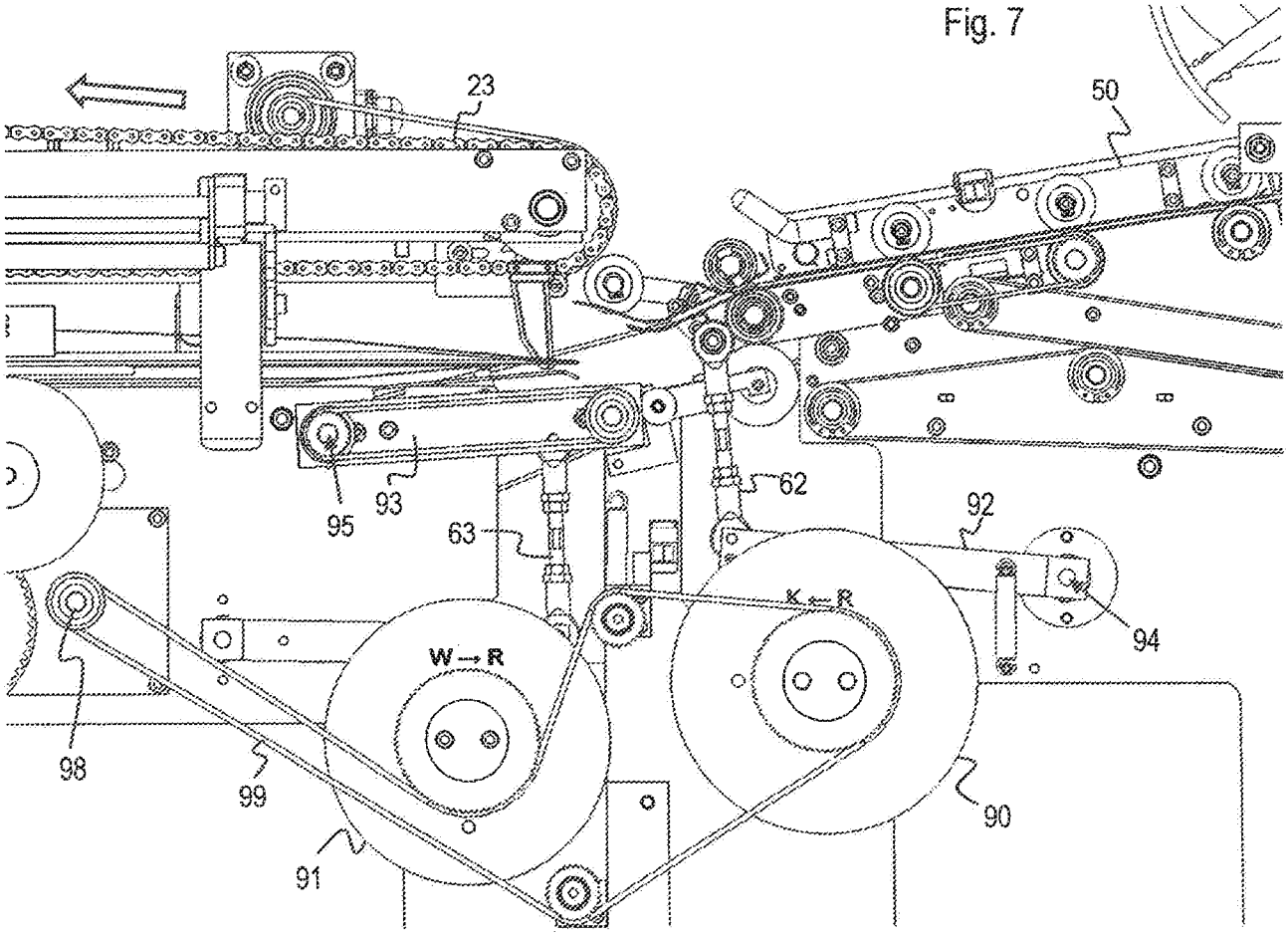
FIG. 7 shows a side view detail with cam discs (analogously to FIG. 5)

As shown in FIG. 6, the envelope 5 is inserted into the envelope duct 11 with the closed envelope flap 8 facing downwards according to an embodiment of a method according to the invention. The flap is opened by the envelope towing wheel 12 and the envelope 5 is pulled out of duct 11 with the flap 8 open. It is then transported in a curve with the flap open first into envelope transporter 50.

Figure 2:
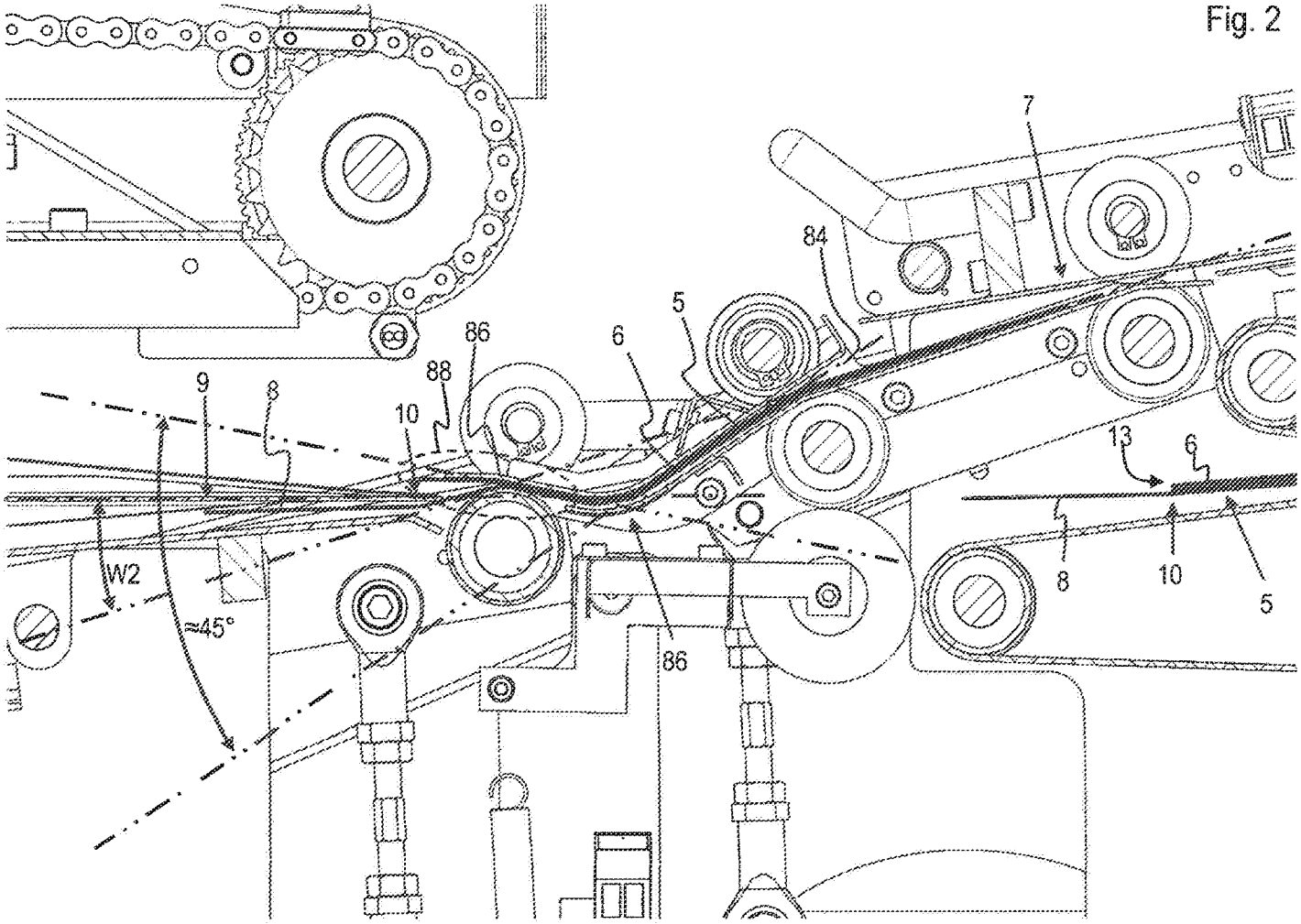
FIG. 2 shows the envelope flap fold above the packing pocket

The opened envelope flap is located in the envelope transporter 50 and down in further progress, as shown in FIG. 2.

Figure 1:
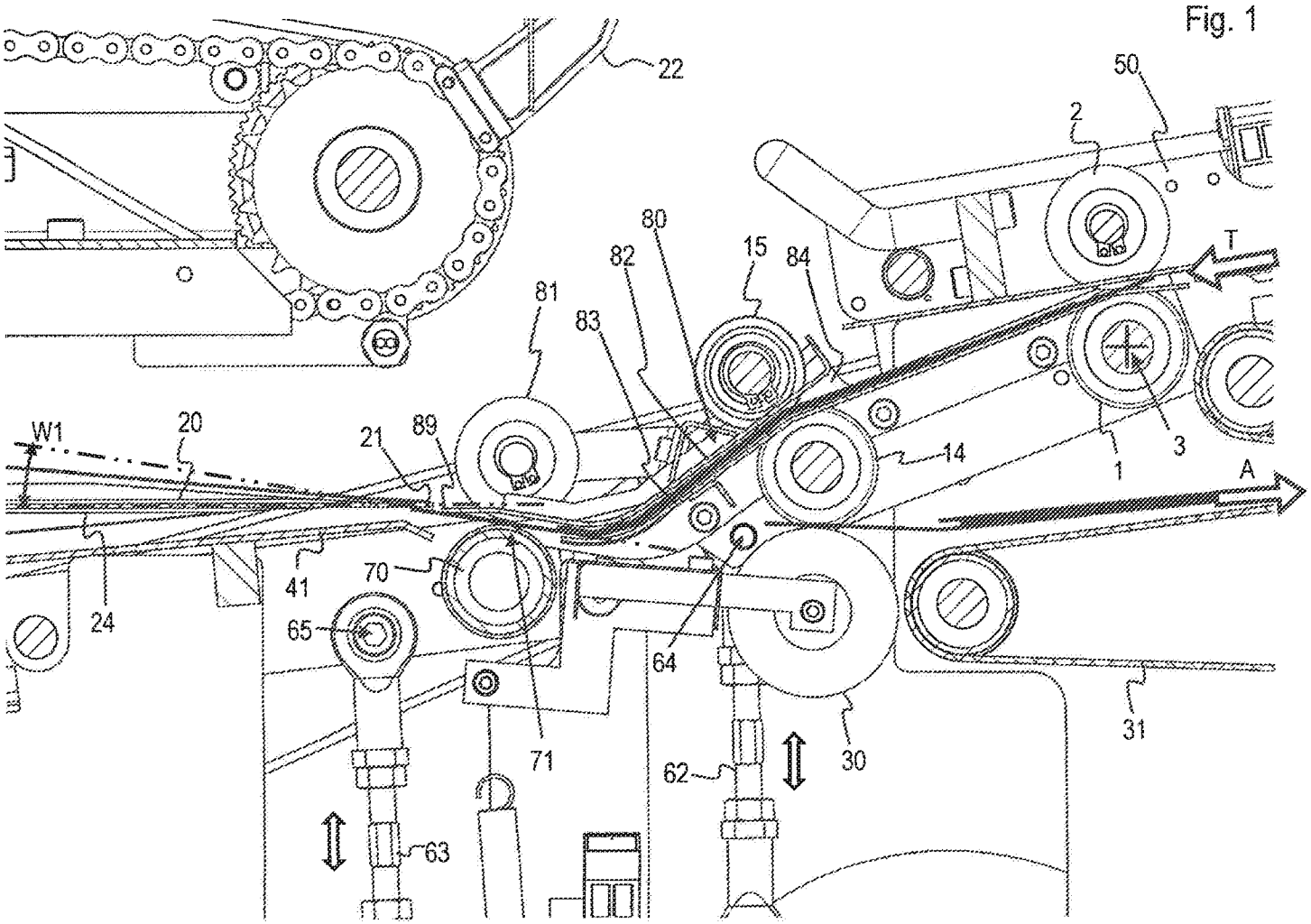
FIG. 1 shows the envelope flap front edge under the packing pocket

The envelope 5 is now fed to the envelope tunnel 80, as shown in FIG. 1, with the envelope flap 8 or flap front edge 9 open, by means of pair of rolls 1, 2. The envelope tunnel 80 is formed in the entrance area 84 by two tunnel guidances 82, 83, which initially converge in a funnel shape, then parallel, straight at first and then form a curve, here made of sheet metal, wherein said guidances limit the transport path of the envelope towards the top and bottom. Alternatively, to further reduce weight, a version made of titanium, carbon fiber composite, in particular made of anti-wear coated carbon fiber composite material, is also possible. Alternatively, it is also possible to use guide rods, in particular made of the above-mentioned materials. In this case, curve 85 deflects the transport path of the envelope at an angle of approx. 45° from a direction diagonally downwards to a direction diagonally upwards. Upstream, the lower tunnel guidance 83 is extended beyond the roll pair 1, 2 into the area of the envelope transporter 50. Downstream, the upper tunnel guidance 82 is extended beyond the interaction area 71 of the envelope pusher roll 70 and the optional back-pressure roll 81 to the immediate vicinity of the front edge 21 of the packing pocket 20. The back-pressure roll 81 acts through one or, if several rolls are used, through several recessed cut-outs in the upper tunnel guidance 82, downstream of curve 85 outside the tunnel-shaped area of the envelope tunnel 80. The lower tunnel guidance 83, on the other hand, ends downstream, in the positions shown in FIGS. 1 to 3, immediately before the interaction area 71.

Although the embodiment shown here has advantages for the guidance of an envelope type with medium flap length shown here, other configurations are also possible here in principle. For example, the back-pressure roll 81 can even be omitted, since the envelope tunnel is designed in such a way that it provides the counterforce required to form sufficient friction on the envelope pusher roll 70. Curve 85 can also be set to a greater or lesser change in the direction of the transport path, for example in a range from 30° up to and including 60°, and the kink 86 can be set to a range from 0° to 20°, preferably between 5° and 15°, depending on how far the upper tunnel guidance extends beyond the interaction area. The distance between the essentially parallel guides can be selected between 1 and 5 mm, in particular approx. 3 mm, or it can also vary in the different sections. The length of the parallel section can be set between one quarter and three quarters of the minimum envelope length to be processed (distance between envelope bottom 7 and flap edge 10), in particular approx. half an envelope length. The majority of the parallel guidance through guidances 82 and 83 is located upstream of curve 85, whereas the lower guidance can end downstream immediately after the curve.

The shape of the tunnel also depends on the angle and height at which the envelope transporter 50 is arranged, the roll diameters on which it is based, etc. Due to such adjustments, the above values may vary further. Instead of sheet metal, the envelope tunnel can also be made of other materials, in particular to reduce the moving mass. This can include titanium, carbon fiber material or others, as well as the design of the envelope tunnel, for example by means of guide rods.

In the further course the envelope is further transported through the pair of rolls 14, 15 firmly connected to the tunnel 80 and inserted into the envelope tunnel 80, as shown in FIGS. 1 and 2. The pair of rolls 14, 15 acts through one or, if several pairs of rolls are used, through several cut-outs in the lower tunnel guidance 83 and the upper tunnel guidance 82 in the entrance area 84 of the envelope tunnel 80. At the time the flap leading edge 9 of the envelope 5 enters the envelope tunnel 80, it is in the position shown in FIG. 5.

This envelope tunnel is movable up and down around the pivot point of the axis of feed roll 1. This pivot point is advantageous, but not necessarily attached to the axis of feed roll 1.

The movement is controlled such that when the flap front edge 9 reaches the end of the envelope tunnel 80, the envelope tunnel has reached the position shown in FIG. 1.

As a result, the front edge of the flap 9, and thus the flap 8 itself, runs under the packing pocket 20. The envelope is further transported by the envelope pusher roll 70 with the (optional) back-pressure roll 81. The envelope pusher roll is provided with a rubber, polyurethane or corundum coating with a good grip, which provides the necessary friction and thus a safe feed. Thus, in many cases the back-pressure roll 81 can be dispensed with, since sufficient friction is already generated by the friction lining of the envelope pusher roll and the counterforce of the upper tunnel wall 82.

The movement of the envelope tunnel 80 is controlled in such a way that as soon as the front edge 9 of the envelope flap arrives under the packing pocket, the envelope tunnel 80 and the envelope pusher roll 70 are raised synchronously, so that during this movement the envelope is transported further by the envelope pusher roll 70 and the envelope flap 8 is pushed further under the packing pocket 20. The movements of the envelope tunnel 80 and the envelope pusher roll 70 are synchronously upwards at this time.

Figure 8:
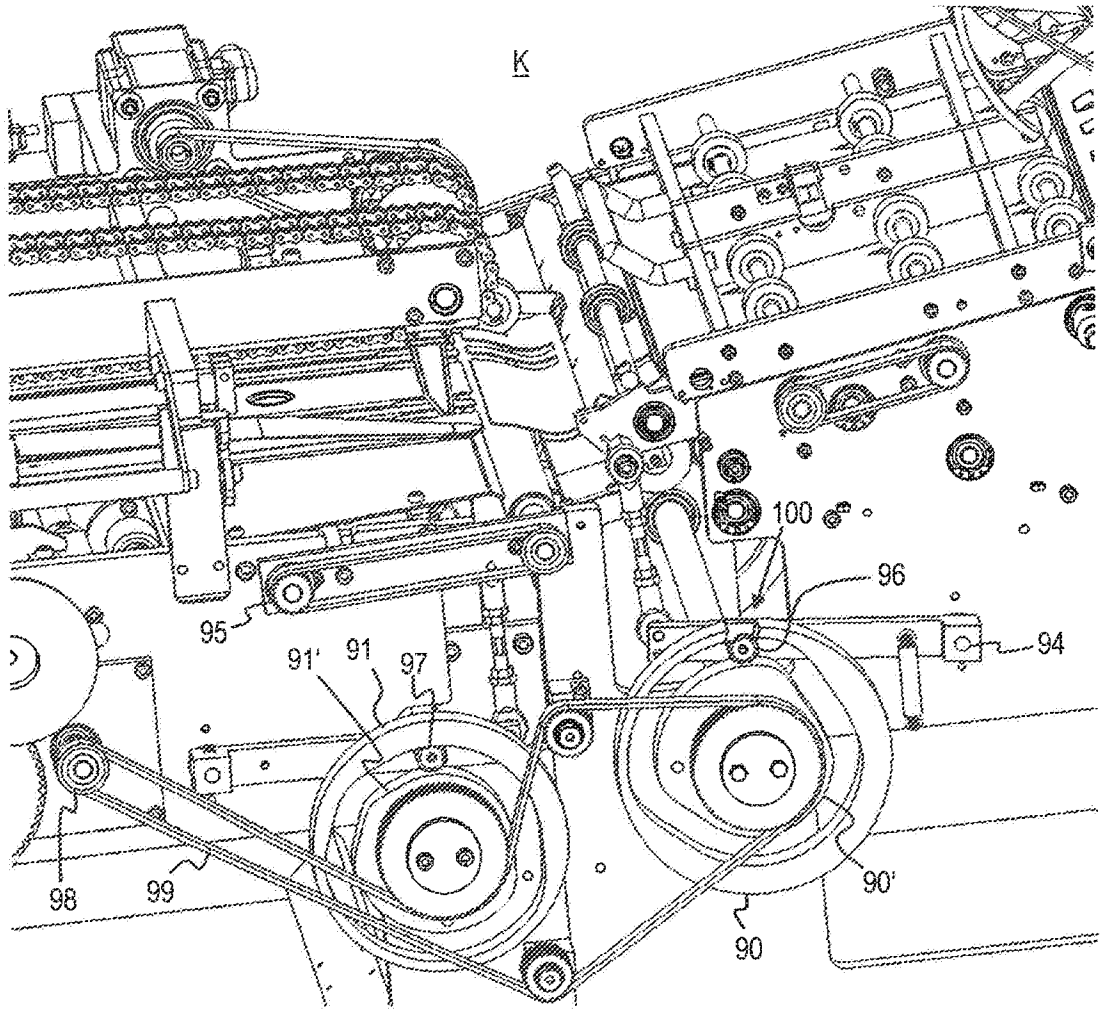
FIG. 8 shows a 3D view (analogously to FIG. 5)

The movements are controlled synchronously (but in different ways in the course of a cycle) by the cam discs 90, 91 driven by the same drive. The rear internal trapped control cams 90' and 91' are shown in FIG. 8 using transparent cam discs 90, 91. Trapped curves here are understood to be control cams in which a guided guide pin 96, 97 is steered by guiding surfaces on both sides with little play in a groove-shaped cam track. The design of the guide pin in the cam track as a roll, as shown, is preferred here, e.g. as a rotatable roll running on a stationary pin. An external control cam with spring-loaded lever would also be possible. The curves of the cam discs move the envelope tunnel 80 and the envelope pusher roll 70 via levers 92, 93 and 62, 63. The pivot points of the levers are located at 94 and 95 respectively.

An advantage of this design is that both the drive of the transport rolls 1 and 14 and the envelope pusher roll 70 (rolls 2, 15, 81 are loosely following idle rolls) as well as the movements of the cams 90 and 91 and thus of the envelope pusher roll 70 and the envelope tunnel 80 are carried out from a central drive. This is inexpensive and due to the fixed mechanical coupling these movements run absolutely synchronously. In the chosen design, this drive simultaneously drives the collecting chain (which feeds the documents), which increases reliability (synchronization) and minimizes manufacturing costs.

The movement of envelope tunnel 80 and envelope pusher roll 70 is further controlled so that before the flap edge 10 arrives at the front edge 21 of the packing pocket, the upper edge of the envelope pusher roll and the lower edge of the upper tunnel guidance of the envelope tunnel lie above the packing pocket, as shown in FIG. 2. This movement opens the envelope so that the envelope flap is located under the packing pocket and the upper backside of the envelope slides over the packing pocket. The envelope is then completely pushed onto the packing pocket 20 by the envelope pusher roll 70. The position of the envelope pusher roll 70 and the envelope tunnel 80 remain in the position shown in FIG. 2 during this time. Due to the very short distance between envelope pusher roll 70 and packing pocket 20 as well as envelope tunnel 80 and packing pocket 20, a very well guided transport and a possible buckling of the envelopes 5 due to resistance forces during push-on is reliably prevented. This exact guidance also allows thin envelope papers, wavy envelopes and envelopes of inferior quality to be reliably processed. The non-driven back-pressure roll 81 is fixed to the envelope tunnel and moves with it. It provides the necessary back pressure for safe transport. This back-pressure roll is not mandatory for all envelope qualities, but is helpful for processing the entire range of envelope qualities without further adjustments.

The guide plate 41 visible in the figures has no function for the transport and filling process.

Figure 3:
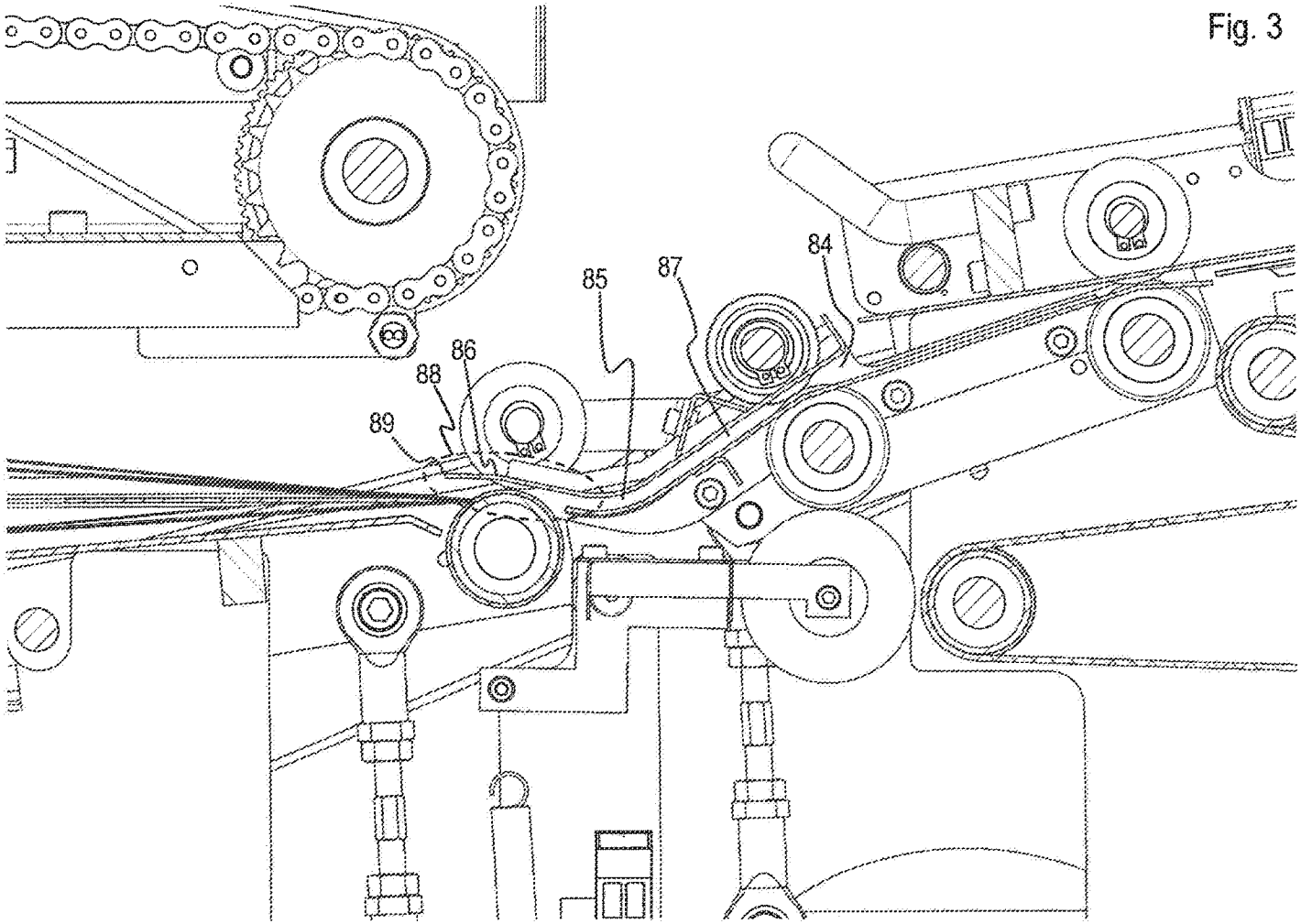
FIG. 3 shows the envelope readily pushed onto the packing pocket

The positions of the envelope pusher roll 70 and envelope tunnel 80 shown in FIG. 3 correspond to those in FIG. 2. They remain in this position until envelope 5 is fully pushed onto packing pocket 20. The envelope 5 was further transported here and completely pushed onto the packing pocket 20.

Figure 4:
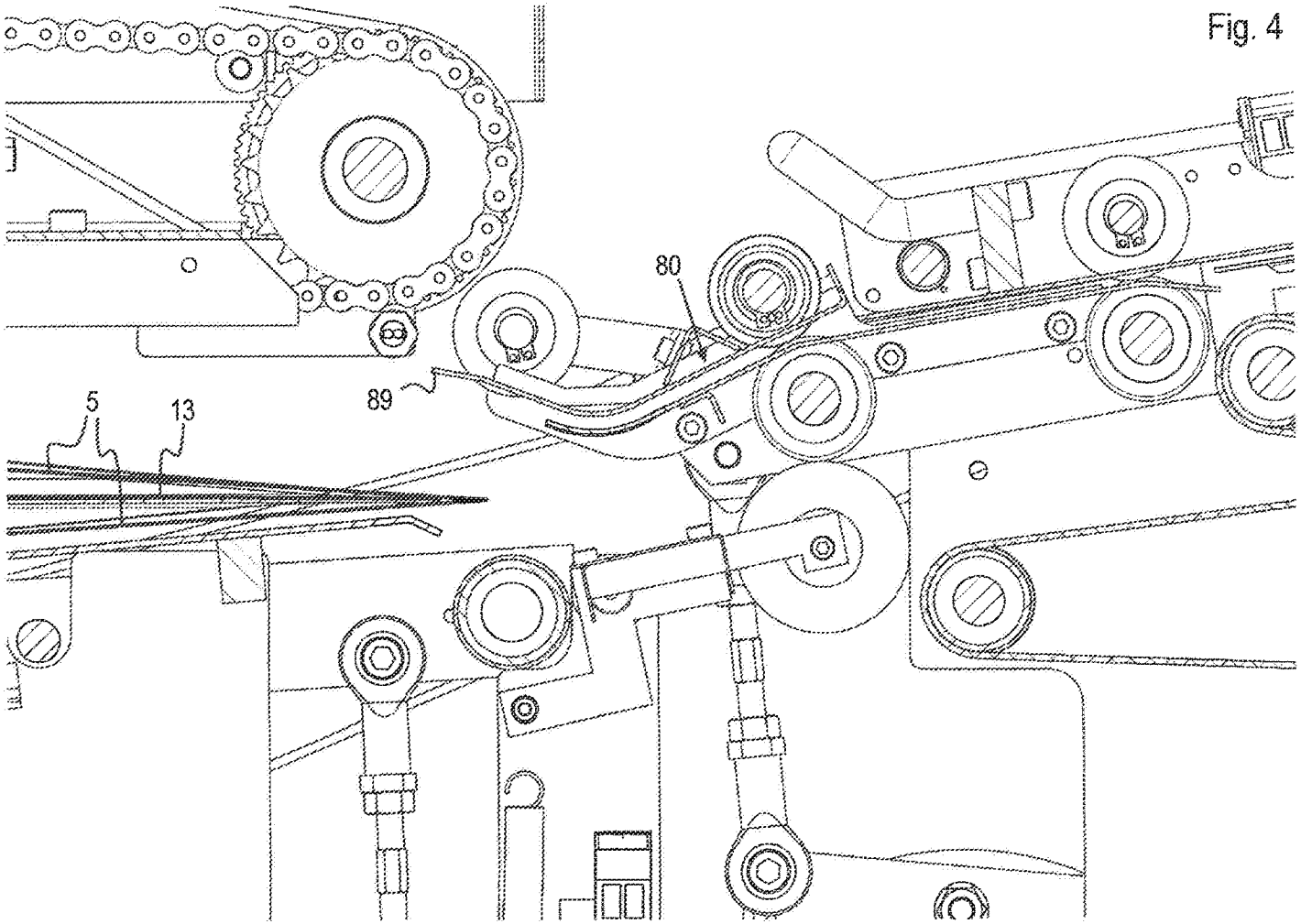
FIG. 4 shows when the envelope is pushed away from the packing pocket, start

As soon as the envelope bottom 7 has left the envelope tunnel 80 and the envelope pusher roll 70, and the envelope 5 is completely pushed onto the packing pocket 20, the position of the envelope pusher roll 70 and envelope tunnel 80 is changed again. The envelope pusher roll 70 is lowered in this case in the direction of a lower end position, while the envelope tunnel 80 is simultaneously raised to an upper end position. This position is shown in FIG. 4.

Envelope pusher roll 70 and envelope tunnel 80 have reached their end positions and thus allow space to eject the envelope 5, now filled with envelope content 13, against the previous transport direction.

While the envelope is being pushed onto the packing pocket, the upper insertion chain 23 begins to insert the content taken over from the collecting chain inside the packing pocket into the envelope pushed over the packing pocket with its finger 22 (not visible in the figures). This is controlled in such a way that insertion already begins before the envelope is completely pushed on, but the front edge of the content only reaches the envelope bottom or the edge 21 of the packing pocket (FIG. 4) shortly after the envelope has been completely pushed onto the packing pocket (FIG. 3). The collecting chain, which runs slower than the insertion chain, also transports the envelope content by means of fingers. It is located below the upper insertion chain at the level of the packing pocket and is not shown in the figures. The insertion chain 23 continues to run and pushes the content completely into the envelope with the finger 22 and during the further run the envelope together with the content back down from the packing pocket until the envelope is picked up by the transport roll 14 and the back-pressure roll 30 underneath and transported further towards the exit onto the following transport belt 31.

Figure 5:
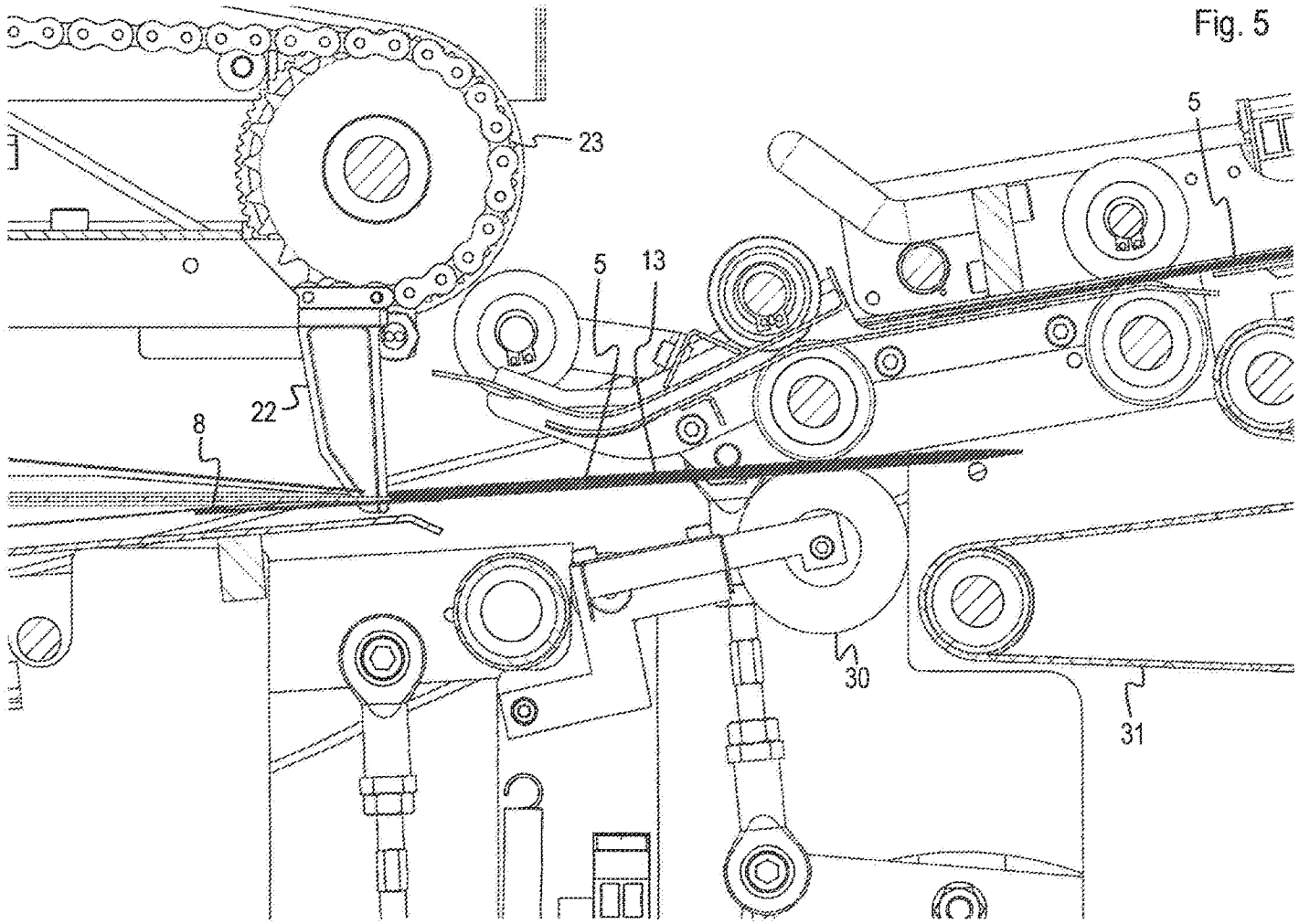
FIG. 5 shows when the envelope is pushed away from the packing pocket

This is illustrated in FIG. 5. The envelope 5 with content 13 has been pushed almost completely from the packing pocket 20 by the fingers 22 of the upper insertion chain 23 and is further transported by the driven transport rolls 14 and the lower outlet roll 30. The driven transport roll 14 has a double function in this case: together with the transport roll 30 at the bottom, it removes the filled envelope, while at the same time the next empty envelope is fed together with the transport roll 15 at the top.

The outlet roll 30 is capable of compensating for the thickness of the filled envelope by being spring-loaded or self-sprung. Instead of a roll, segments can also be used here as are known from the prior art. Basically the term roll is used here synonymously to cylinder, i.e. if one or more rolls are specified for a certain function, these can easily be replaced by a wide roll for example, i.e. a cylinder. Also, if not explicitly excluded or obviously not otherwise possible, the specification of a roll always includes a configuration with multiple rolls.

Shortly before the pair of rolls 14, 15 the next empty envelope 5 is already visible.

Next, the movement of envelope pusher roll 70 and envelope tunnel 80 begins again in the direction of the position in FIG. 1. With the envelope tunnel 80, the driven transport roll 14, transport roll 15 and back-pressure roll 30 are also lowered, so that the envelope with content 13 then comes to rest on the transport belt 31, which then transports the envelope 5 further to the optionally integrated flap closing, gluing and exit stations.

The filled, and therefore mostly stiff, part of envelope 5 has completely left the packing pocket 20 when this movement of the envelope tunnel begins. The envelope flap 8 can then still be partially located in the packing pocket 20, but is flexible enough to adapt to the movement because it consists of only one layer of paper. At the end of the movement of envelope pusher roll 70 and envelope tunnel 80, the empty envelope has been transported further and the position of FIG. 1 is reached again. In FIG. 1 the envelope 5 in transport can be seen on the conveyor belt 31. An attempt will be made to reach this position as early as possible, but it must be ensured that the longest possible flap of the empty envelope 5 cannot collide with the longest possible flap of the envelope 5 in transport.

As a special feature, as can be seen in the 3D view of FIG. 8, the curve of the envelope tunnel 80 is designed by a recess 100 in the outer guiding surface so that at the time of the zero position of the machine, which corresponds to the position shown in FIG. 5, the guide pin or roll 96 can be manually moved upwards out of the guideway. This allows the envelope tunnel to be raised further despite the trapped curve in the zero position of the machine, so that in the event of a jam the machine can be unclamped and the accumulated material can be removed relatively quickly and conveniently (user-friendliness).

The above embodiment achieves the goals of low manufacturing costs, high reliability and low wear, while at the same time offering a high degree of flexibility with regard to a wide variety of envelope formats and qualities, thanks to its simple, compact design and mechanically coupled and therefore always synchronous movements without the need for control.

With a lower priority of the target concerning production costs, it is possible to replace the mechanical curves by electric drives, e.g. servo drives, with an electronic gear in order to drive different curves depending on the exact geometries of the envelope flaps, so that the performance can be further increased for ideal conditions of the envelope flap, while all variants of envelopes can still be processed. By storing the corresponding parameters in the plant control system, flexibility and user-friendliness are not restricted.

The following advantages, which are only listed by way of example, result from the use of an inserting system according to the invention as described here:

- The envelopes are guided precisely through the envelope tunnel reaching as far as the packing pocket. Due to the very short distance between this guide and the packing pocket, the envelope can be transferred very precisely, so that higher outputs can be achieved.
- Due to the long and very precise guidance of the envelopes in the envelope tunnel, even thin papers and wavy envelopes can be safely processed. This makes switching between different envelopes and envelope qualities considerably safer.
- The curve in the envelope tunnel preforms the envelopes so that deformation "out in the open" directly in front of the packing pocket is kept to a minimum, which increases reliability.
- With mechanically fixed coupled cam discs, the movements can be synchronized cost-effectively and precisely without any control effort.
- If the cam discs are driven by the chain drive of the collecting section (collecting chain and insertion chain) of the inserting machine, a separate drive is saved, which reduces costs and increases reliability, since it is always synchronous.
- The movements of the two curves can be designed in such a way that they function reliably without adjustment for all machine-suitable envelopes, regardless of the flap shape and flap length.
- The envelope pusher roll transports the envelope directly to the packing pocket and thus transports it safely and in the best possible way without free flight. As soon as the envelope has left the envelope pusher roll, the envelope is pushed onto the packing pocket practically up to the stop, i.e. envelope bottom at the edge of the packing pocket, in any case sufficiently far, so that only a very short distance remains between the envelope bottom and the edge of the packing pocket, which can be overcome by the process dynamics. The envelope is therefore completely pushed on by turning the envelope pusher roll. It should be noted here in this respect that inside the packing pocket the content running inside is safely separated from the envelope pushed on the outside, so that reliable operation is ensured without damaging the content. Even if the envelope is not completely pushed onto the packing pocket due to the roll diameter, this distance is so small that the envelope content can no longer touch the envelope during loading, which can prevent the formation of congestion in the packing pocket. Only when the loading process has been completed does the front edge of the envelope content hit the envelope bottom and push the envelope from the packing pocket, driven by the finger of the insertion chain itself.
- The envelope pusher roll can push the envelope completely onto the packing pocket without any wear, since the envelope has left the envelope pusher roll at a standstill, i.e. after it has been pushed onto the packing pocket. This is in contrast to the envelope pull rolls which are common today and are subject to a high degree of wear and tear, and which have to pull the envelope onto the packing pocket and in this respect show a high degree of wear, especially in the transition phases at the end of the pulling-up process and during empty cycles.
- Two separate curves allow the two movements of the envelope pusher roll and envelope tunnel to be optimally coordinated.
- By means of the envelope pusher roll, the envelope is not pushed onto the packing pocket by a guide, but directly onto the packing pocket, which reduces the risk of a paper jam compared to the prior art. The distance between the transport rolls 14, 15 in or immediately after the entrance area of the tunnel through which the envelope is pushed into the funnel to the envelope pusher roll, which is also driven, is short. The latter can also neutralize the occurrence of counterforces by the impact of the envelope on the packing pocket.
- The extremely short distance between envelope pusher roll and packing pocket as well as envelope tunnel and packing pocket reliably prevents even thin envelope papers from buckling.
- The design is simple which facilitates the operation.
- The mechanical coupling instead of the use of servo drives ensures a cost-effective design and exact synchronization of all movements in each phase (also during acceleration and deceleration ramps).
- The use of a width-adjustable packing pocket with closed guidance, as described in WO 2016/026712 A1 for example, and an envelope tunnel suitable for all envelope lengths and in accordance with the invention, achieves a high degree of flexibility, while at the same time providing a high level of processing security against malfunctions and high quality of the processed documents (protection against damage).

Although special embodiments of the present invention have also been explained in the preceding sections on the basis of figures and examples, special embodiments of individual components mentioned in connection with individual examples, such as envelope tunnels and their subunits (tunnel guidances, rolls), swivel and synchronizing means, etc., can in principle be combined with other special embodiments and examples of the invention, provided that this is not obviously senseless for the person skilled in the art. This invention therefore also includes such combinations, as well as inserting machines with an envelope feed from above, i.e. with an envelope flap at the top, as well as those with an envelope feed from below, where again the envelope flap can be at the top or bottom (see also above).

LIST OF REFERENCE NUMBERS

1 feed roll(s)
2 feed roll(s), (idle roller(s))
3 pivot axis
1, 2 pair of feed rolls
5 envelope
6 backside of the envelope
7 bottom of the envelope
8 envelope flap
9 front edge of flap
10 edge of flap
11 envelope duct
12 envelope towing wheel, flap opener
13 content of envelope
14 transport roll
14, 15 pair of transport rolls
15 transport (idle) roll
20 packing pocket
21 front edge of the packing pocket
22 finger
23 insertion chain
24 guiding surface of the packing pocket
30 outlet roll
31 transport belt
41 guide plate
50 envelope transporter
62, 63 lever
64, 65 load transmission points from 62, 63
70 envelope pusher roll(s), especially as envelope pusher barrel(s)
71 area of interaction
80 envelope tunnel
81 back pressure (optional)
82 upper tunnel guidance
83 lower tunnel guidance
84 entrance area
85 bend
86 kink
87 straight guidance
88 end region
89 end edge
90, 91 cam disc
90', 91' control cam
92, 93 lever
94 pivot point (of lever 92)
95 pivot point (of lever 93)
96, 97 guide pins (also designed as roll)
98 driving wheel
99 driving means
100 recess
T transport direction of the empty envelope
A transport direction of the filled envelope
W1, W2 angle of transport

The invention claimed is:

1. An inserting system for inserting an envelope content into an envelope, the inserting system comprising:
- an envelope duct for empty envelopes,
- an envelope transporter for transporting the envelopes from the envelope duct to a packing pocket for filling the envelopes,
- a feeding device to feed the envelope content to and into the packing pocket, and
- an outlet transporter for reforwarding of the envelope filled with the envelope content, wherein:
- the transporter comprises:
  - an envelope tunnel that is pivotably mounted around a pivot axis at the inserting system, and comprises an upper tunnel guidance and a lower tunnel guidance, for alignment of the envelope onto the packing pocket,
  - a swivel operatively connected to the envelope tunnel, and
  - at least one envelope pusher roll that is configured to be driven,
- the envelope tunnel and the envelope pusher roll are configured to take a first position relative to the packing pocket, in which the envelope pusher roll is positioned bottom-up against a downstream end region of the upper tunnel guidance and a lower edge of an end edge of the end region is offset downwards with reference to a plane defined by a guidance plane of the packing pocket,
- the envelope tunnel comprises an entrance area, a straight guidance region downstream thereof, and a curve adjacent downstream thereof, and
- the upper tunnel guidance and the lower tunnel guidance are formed parallel in the guidance region and in the region of the curve.

2. The inserting system according to claim 1, wherein in the first position the end edge of the end region in a transport direction is located directly in front of a front edge of the packing pocket.

3. The inserting system according to claim 1, wherein the envelope pusher roll and the envelope tunnel are further configured to take an intermediate position raised relative to the first position, in which the envelope pusher roll is positioned bottom-up against the downstream end region of the upper tunnel guidance and the envelope pusher roll is located directly in front of a front edge of the packing pocket with respect to a transport direction.

4. The inserting system according to claim 1, wherein the envelope pusher roll and the envelope tunnel are further configured to take a second position relative to the packing pocket, in which the envelope pusher roll and the envelope tunnel are pivoted away from the front edge, and release a transport path in a transport direction between the packing pocket and the outlet transporter.

5. The inserting system according to claim 1, wherein the packing pocket is fixedly connected to an inserting machine.

6. The inserting system according to claim 4, wherein, in the second position, the envelope pusher roll is pivoted downwards relative to the plane formed by the guiding surface and the envelope tunnel is pivoted upwards relative to the plane formed by the guiding surface.

7. The inserting system according to claim 4, wherein, in the second position, the envelope pusher roll and the envelope tunnel are pivoted upwards with respect to the plane formed by the guiding surface.

8. The inserting system according to claim 1, wherein the envelope pusher roll is connected to a synchronizer.

9. The inserting system according to claim 8, wherein:

the swivel and the synchronizer each comprise a cam disc and at least one lever, the at least one lever of the swivel connects the cam disc to the envelope tunnel and the at least one lever of the synchronizer connects the cam disc to the envelope pusher roll via load transmission points, and the cam discs is capable of being driven jointly by a drive arranged on a device side via a driving wheel and driver.

10. The inserting system according to claim 9, wherein the driver is a drive belt, a toothed belt or a chain.

11. The inserting system according to claim 8, wherein the swivel and synchronizer each comprise a synchronous motor.

12. The inserting system according to claim 1, wherein the envelope tunnel comprises at least one driving roll and at least one idle roll for cooperating with a driving roll.

13. A method for operating an inserting system that comprises:

a transporter for transporting an opened envelope with an envelope flap in advance from an envelope duct to a packing pocket, on which envelopes are filled, a feeding device for feeding and introducing envelope content into the packing pocket, and an outlet transporter for reforwarding a filled envelope, the method comprising:

pushing the envelope flap under a front edge of the packing pocket parallel to or at a transport angle under a guiding surface of the packing pocket in a first step, wherein, in the first step, an envelope tunnel and an envelope pusher roll are positioned in a first position relative to the packing pocket, in which a lower edge of an end edge of an end region of an upper tunnel guidance arranged downstream is offset downwards relative to a plane defined by the guiding surface of the packing pocket, and the envelope pusher roll, when fed from below against the end region, is operated in the transport direction, and pivoting the envelope pusher roll and the envelope tunnel away from the front edge into a second position and thus releasing the transport path in the transport direction between packing pocket and the outlet transporter in a second step after the envelope has been completely pushed onto the packing pocket, wherein in the second step, the envelope pusher roll is pivoted downwards with respect to the plane formed by the guiding surface and the envelope tunnel is pivoted upwards with respect to the plane formed by the guiding surface.

14. The method according to claim 13, wherein, in the first position, the end edge is positioned in the transport direction immediately in front of the front edge of the packing pocket.

15. The method according to claim 14, further comprising, in an intermediate step:

pivoting the envelope pusher roll and envelope tunnel into an intermediate position raised relative to the first position as soon as the envelope flap is located below the guiding surface, wherein the envelope pusher roll is located directly in front of the front edge of the packing pocket in the direction of the transport path, feeding the envelope flap from the envelope tunnel to the packing pocket at the transport angle, further operating the envelope pusher roll from below against the end region of the upper tunnel guidance located downstream in the transport direction, and opening the envelope on the packing pocket for pushing on and subsequent loading with envelope content.

16. The method according to claim 15, wherein, in the intermediate step, the envelope is pushed on by the envelope pusher roll to such an extent that the envelope content does not touch the envelope during loading.

17. The method according to claim 13, wherein the pivoting of the envelope pusher roll and envelope tunnel are synchronized by a swivel and synchronizer.

18. The method according to claim 13, wherein, in the second step, the envelope pusher roll and the envelope tunnel are pivoted upwards away from the plane formed by the guiding surface.

19. The method according to claim 18, wherein the pivoting of the envelope pusher roll and the envelope tunnel is effected by a swivel.

* * * * *